US008106858B2

(12) United States Patent
Gerets

(10) Patent No.: US 8,106,858 B2
(45) Date of Patent: Jan. 31, 2012

(54) AGING COMPENSATION FOR DISPLAY BOARDS COMPRISING LIGHT EMITTING ELEMENTS

(75) Inventor: Peter Gerets, Roeselare (BE)

(73) Assignee: Barco N.V., Kortrijk (BE)

( * ) Notice: Subject to any disclaimer, the term of this patent is extended or adjusted under 35 U.S.C. 154(b) by 1109 days.

(21) Appl. No.: 11/826,237

(22) Filed: Jul. 13, 2007

(65) Prior Publication Data

US 2008/0018570 A1 Jan. 24, 2008

(30) Foreign Application Priority Data

Jul. 14, 2006 (EP) ..... 06014750

(51) Int. Cl.
*G09G 3/32* (2006.01)

(52) U.S. Cl. ..... 345/82; 345/84

(58) Field of Classification Search ..... 345/76–104, 345/204–215; 250/552; 39/44
See application file for complete search history.

(56) References Cited

U.S. PATENT DOCUMENTS

| | | | | |
|---|---|---|---|---|
| 2004/0070558 | A1 | 4/2004 | Cok et al. | |
| 2005/0280766 | A1 * | 12/2005 | Johnson et al. | 349/167 |
| 2006/0119592 | A1 | 6/2006 | Wang et al. | |

FOREIGN PATENT DOCUMENTS

| | | | |
|---|---|---|---|
| CN | 1682267 | A | 10/2005 |
| EP | 0 425 210 | A2 | 5/1991 |
| EP | 1 158 483 | A2 | 11/2001 |
| EP | 1 335 430 | A1 | 8/2003 |
| WO | 02/097774 | A2 | 12/2002 |
| WO | WO 02/097774 | A2 | 12/2002 |
| WO | WO 2004/025615 | A | 3/2004 |
| WO | WO 2004/025615 | A1 | 3/2004 |

OTHER PUBLICATIONS

European Search Report dated Oct. 17, 2007 in European Application No. EP 07 01 3567 (1 page).
Office Action issued in related European application No. 07 013 567.8 dated Jan. 20, 2011, 8 pages.
Office Action issued in related Chinese application No. 200710136867.X, Mar. 7, 2011, 24 pages.

* cited by examiner

*Primary Examiner* — Kevin M Nguyen
*Assistant Examiner* — Kenneth B Lee, Jr.
(74) *Attorney, Agent, or Firm* — Bacon & Thomas, PLLC

(57) ABSTRACT

The present invention provides a display board (30) comprising an array of light emitting elements (31), a driving means (32) for driving the light emitting elements (31) with image data, and an aging determination means (33). The aging determination means (33) comprises one or more light emitting elements for emitting light representative of the light emitted by the light emitting elements (31) of the display board (30), and at least one reference light emitting element (35) which, during use of the display board (30) is not driven. At the time of an intermediate calibration, the at least one reference light emitting element (35) is driven with calibration data and the light emitted by the reference light emitting element (35) is measured, as well as light representative of the light emitted by the light emitting elements. The difference between the light emitted by the at least one reference light emitting element (35) and the light representative of the light emitted by the light emitting elements is a measure for the degree of aging of the light emitting elements (31) of the array.

25 Claims, 8 Drawing Sheets

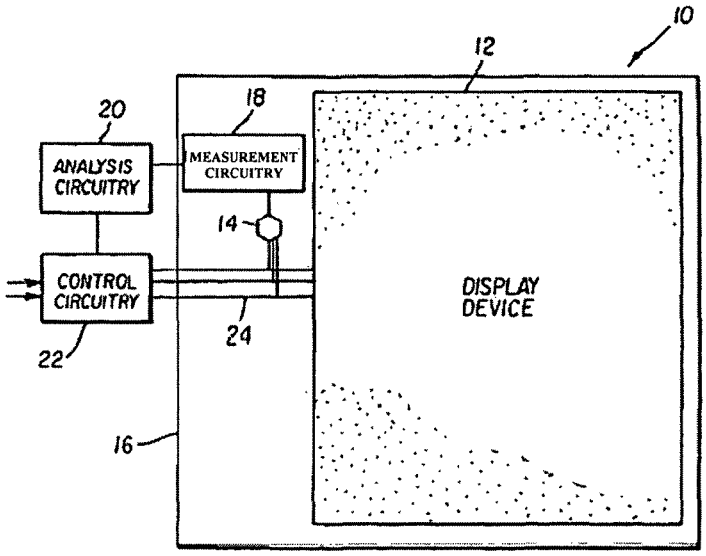
FIG. 1 – PRIOR ART
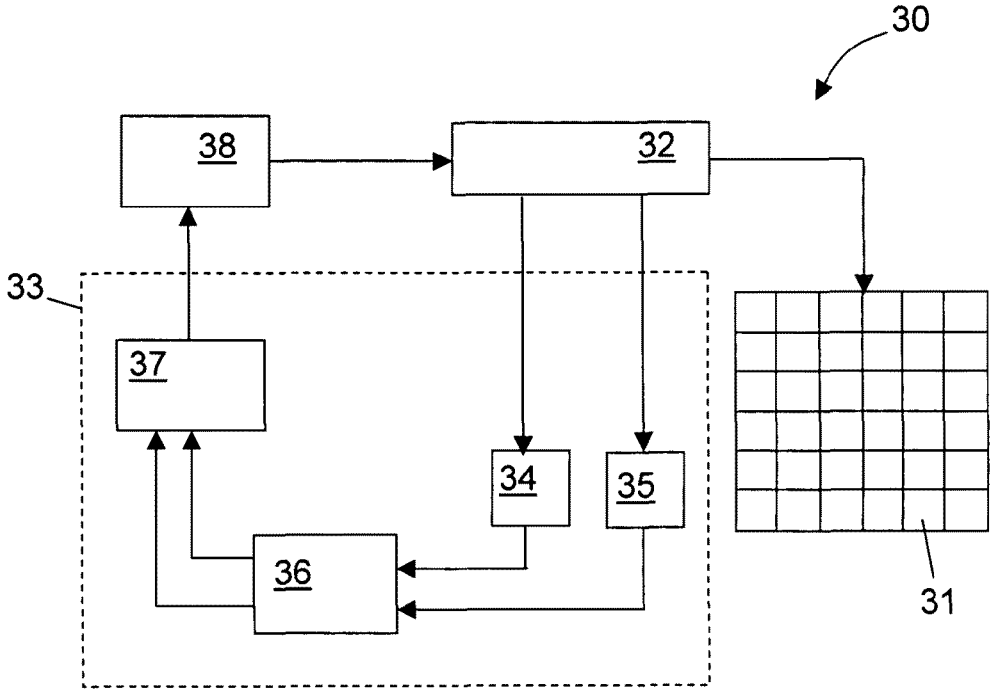
FIG. 2

AGING COMPENSATION FOR DISPLAY BOARDS COMPRISING LIGHT EMITTING ELEMENTS

TECHNICAL FIELD OF THE INVENTION

The present invention relates to display boards comprising light emitting elements and methods of constructing and operating these. More particularly, the present invention relates to aging of the light emitting elements of such display boards and methods of operating these taking into account aging.

BACKGROUND OF THE INVENTION

Electronic displays can use transmissive or emissive materials to generate pictures or light. Emissive materials are usually phosphorescent or electroluminescent materials. Examples are inorganic electroluminescent materials such as applied in thin film and thick film electroluminescent displays (EL-displays, for example thin film TFEL displays as manufactured by Sharp, Planar, LiteArray or iFire/Westaim) or light emitting diodes (LEDs). Another group is organic electroluminescent materials (such as Organic Light Emitting Diode or OLED materials) deposited in layers comprising small molecule or polymer technology or phosphorescent OLED, where the electroluminescent materials are doped with a phosphorescent material. Yet another group of materials are phosphors, commonly used in the well-established cathode ray tubes (CRT) or plasma displays (PDP) and even in emerging technologies like laser diode projection displays where the laser beam is used to excite a phosphor imbedded in a projection screen.

Two basic types of displays exist: fixed format displays which comprise a matrix or array of "cells" or "pixels" that are individually addressable, each producing or controlling light over a small area, and displays without such a fixed format, such as scanning electron beam displays, e.g. a CRT display. Fixed format relates to pixelation of the display as well as to the fact that individual parts of the image signal are assigned to specific pixels in the display.

Tiled displays may comprise modules made up of tiled arrays which are themselves tiled into supermodules. Modular or tiled emissive displays, such as e.g. tiled LED or OLED displays, are made from smaller modules or display boards that are then combined into larger tiles. These tiled emissive displays or display tiles are manufactured as a complete unit that can be further combined with other display tiles to create displays of any size and shape.

All light emitting elements on display boards and display tiles can be formed from different batches, can have different production dates, different run times, etc, i.e. they can have different properties. In the factory, i.e. before real use, all light emitting element products are calibrated under controlled circumstances. However, there is one parameter which can only be compensated based on statistical data and not on actual data, and that is the aging or degradation of the light emitting elements when they are being used. Age differences occur, for example, due to the varying ON times of the individual light emitting elements (i.e., the amount of time that the light emitting elements have been active) and due to temperature variations within a given display area.

For large-screen applications, where the display may consist of a set of tiled display boards, there is the possibility that one display will age at a faster rate than another, because of varying ON times of its light emitting elements and/or because of temperature differences. Typically, when a tiled display is manufactured, it is calibrated for a uniform image. The challenge in a display comprising light emitting elements is to make its light output uniform, i.e. to make all light emitting elements on the display board to have the same brightness, even after having been used.

In EP 1 158 483 a system 10 is described which corrects for the aging of the pixels in a display. The system 10 comprises a solid-state display device 12. The system 10 uses reference pixels 14 to enable the measurement of pixel performance and a feedback mechanism responsive to the measured pixel performance to modify the operating characteristics of the display device 10 (see FIG. 1). The characteristics of the reference pixels 14 are measured by a measurement circuit 18 and the information gathered thereby is connected to an analysis circuit 20. The analysis circuit 20 produces a feedback signal that is supplied to a control circuit 22. The control circuit 22 modifies the operating characteristics of the image display 10 through control lines 24.

According to EP 1 158 483, the measurement circuit 18 monitors the performance of the reference pixel 14. The measured performance values are compared to the expected or desired performance by the analysis circuit 20. These comparisons can be based on a priori knowledge of the characteristics of the device 12 or simply compared to some arbitrary value empirically shown to give good performance. In either case, once a determination is made that the performance of the device 12 needs to be modified, the analysis circuitry 20 signals the feedback and control mechanism which then initiates the change.

In the system 10 according to EP 1 158 483, however, errors in the measurement circuit 18 can lead to errors in the correction or change. Furthermore, the value the measured performance values are compared to is not exactly measured under the same circumstances as the measured performance values and thus can include small deviations from a reference value which would be measured under the same circumstances as the performance value. This could lead to errors in the correction or change.

SUMMARY OF THE INVENTION

It is an object of the present invention to provide good display boards and a good method for determining aging of light emitting elements in such a display board.

The above objective is accomplished by a method and device according to the present invention.

In a first aspect, the present invention provides a display board comprising an array of addressable light emitting elements and driving means for driving the light emitting elements with image data. The display board furthermore comprises aging determination means comprising:

at least one reference light emitting element, the driving means being adapted for driving the at least one reference light emitting element with calibration data, light measurement means for measuring light emitted by the reference light emitting element, and for measuring light representative of the light emitted by the light emitting elements, and comparison means for comparing measured light emitted by the reference light emitting element with measured light representative of the light emitted by the light emitting elements and for, based on the comparison result, deciding on aging of the light emitting elements in the array.

Light representative of the light emitted by the light emitting elements may be light emitted by the light emitting elements themselves. Alternatively, this may be light emitted by a reference light emitting element.

In embodiments of the present invention, the light emitting elements and the at least one reference light emitting element may be of different types, i.e. light emitting elements having different performance properties. For example the light emitting elements of the display board may be power LEDs and the at least one reference light emitting element may be a cheaper type of LEDs such as SMD LEDs.

In alternative embodiments of the present invention, the light emitting elements of the display board and the at least one reference light emitting element may be of the same type, i.e. have same performance properties. They may for example be both power LEDs, or they may both be SMD LEDs.

In an embodiment, the present invention provides a display board comprising an array of addressable light emitting elements and driving means for driving the light emitting elements with image data. The display board furthermore comprises aging determination means comprising:

at least a first and second reference light emitting element, the driving means being adapted for driving the first reference light emitting element at first moments in time with reference data equal to a value derived from the image data for driving the light emitting element of the array and with first calibration data at second moments in time, and for driving the second reference light emitting element at the second moments in time with second calibration data, light measurement means for measuring light emitted by the first and second reference light emitting element, and comparison means for comparing measured light emitted by the first reference light emitting element with measured light emitted by the second reference light emitting element and for, based on the comparison result, deciding on aging of the light emitting element in the array.

With first moments in time is meant the moments at which the display is running, in other words, when the light emitting elements of the array are driven with image data. With second moments in time is meant the moments at which intermediate calibrations are performed.

An advantage of the display board according to embodiments of the invention is that both the reference and the aged value are determined on a same display board. This leads to more reliable and more correct determination of aging with respect to prior art devices where the aged value is compared to pre-determined values.

According to embodiments of the invention, the value derived from the image data may be an average value of the image data.

The display board may furthermore comprise compensation means for compensating the light emitting elements in the array for aging based on the decision on aging. However, according to other embodiments, the compensation means may also be located outside the display board.

An advantage hereof is that at every moment in time, compensation for aging differences between the light emitting elements of the array can be performed.

The display board may furthermore comprise a controller for controlling the driving means.

According to embodiments of the invention, the array of light emitting elements may be provided at a first side of the display board and the first and second reference light emitting elements may be provided at a second side of the display board, the second side being opposite to the first side.

An advantage hereof is that adding the first and second reference light emitting elements does not alter the size of the display board and does not disturb the image as it is not part of the array of display elements.

According to other embodiments of the invention, the array of light emitting elements may be provided at a first side of the display board and the first reference light emitting element may be provided at the first side of the display board and the second reference light emitting element may be provided at a second side of the display board, the second side being opposite to the first side.

According to still other embodiments of the invention, the first and second reference light emitting elements may be provided at a same side of the display board as the array of light emitting elements.

According to some embodiments, the first reference light emitting device may be part of the array of light emitting devices.

In particular embodiments, the first and second reference light emitting elements may be coupled to a same light measurement means.

An advantage hereof is that there is not only compensated for aging of the display light emitting elements, but that there is also compensated for aging drift of the light measurement means, e.g. photodiode or phototransistor. This is because if the difference is made between the measurements both performed by a same light measurement means, possible errors emanating from the light measurement means can be excluded.

The light measurement means may comprise at least one photodetector or phototransistor.

According to embodiments of the invention, the display board may comprise light emitting elements of different colours and a first and a second reference light emitting element may be provided for each colour.

According to other embodiments of the invention, the display board may comprise multi-coloured light emitting elements and the aging determination means may comprise one first and one second reference light emitting element, the first and second light emitting elements being multi-coloured light emitting elements.

The light emitting elements of the array may be LEDs.

The display board according to embodiments of the invention may be incorporated in a display tile.

A plurality of display tiles may form a display.

In a second aspect, the present invention provides a method for determining aging of a display board, the display board comprising an array of light emitting elements, driving means for driving the light emitting elements with image data, and at least one reference light emitting element. The method comprises:

measuring light representative of the light emitted by the light emitting elements, driving the reference light emitting element with calibration data and measuring light emitted by the reference light emitting element, and comparing the light representative of the light emitted by the light emitting elements with the light emitted by the reference light emitting element and, based on the comparison result, deciding on aging of the light emitting elements in the array.

It is an advantage of embodiments of the present invention that a reference light emitting element essentially not driven, so not showing ageing effect, is on-board of the display board. Such reference light emitting element may be of the same type or of different type compared to the light emitting elements of the display board.

Measuring light representative of the light emitted by the light emitting elements may comprise measuring light emitted by the light emitting elements themselves.

In an alternative embodiment measuring light representative of the light emitted by the light emitting elements may comprise measuring light emitted by a reference light emitting element. In this embodiment, a method is provided for determining aging of a display board, the display board comprising an array of light emitting elements, driving means for driving the light emitting elements with image data and at least a first and second reference light emitting elements. The method comprises:

driving the first reference light emitting element with first calibration data and measuring light emitted by the first reference light emitting element, driving the second reference light emitting element with second calibration data and measuring light emitted by the second light emitting element, and comparing the light emitted by the first light emitting element with the light emitted by the second light emitting element and, based on the comparison result, deciding on aging of the light emitting elements in the array.

An advantage of the method according to embodiments of the invention is that both the reference and the aged value are determined on a same display board. This leads to more reliable and more correct determination of aging with respect to prior art devices where the aged value is compared to pre-determined values.

The first calibration data may be equal to or may be different from the second calibration data.

The method may comprise before driving the first and second reference light emitting elements with first and second reference data respectively, driving the light emitting elements of the display board with image data and driving the first reference light emitting element with a value derived from the image data.

According to embodiments of the invention, the value derived from the image data may be an average value of image data.

In a further aspect of the invention, a method is provided for calibrating a display board, the display board comprising an array of light emitting elements. The method comprises:

determining the degree of aging of the light emitting elements of the array in accordance with a method according to embodiments of the invention, and compensating the light emitting elements in the array for aging based on the determined degree of aging.

Compensating the light emitting element in the array for aging may be performed by adapting a driving parameter of the light emitting elements of the array.

According to embodiments of the invention, the driving parameter may be a voltage.

According to other embodiments of the invention, the driving parameter may be a current.

Particular and preferred aspects of the invention are set out in the accompanying independent and dependent claims. Features from the dependent claims may be combined with features of the independent claims and with features of other dependent claims as appropriate and not merely as explicitly set out in the claims.

Although there has been constant improvement, change and evolution of devices in this field, the present concepts are believed to represent substantial new and novel improvements, including departures from prior practices, resulting in the provision of more efficient, stable and reliable devices of this nature.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention as defined by the claims. The reference figures quoted below refer to the attached drawings.

BRIEF DESCRIPTION OF THE DRAWINGS

FIG. 1 illustrates a display device according to the prior art.

FIG. 2 is a block-schematic diagram of a device in accordance with embodiments of the present invention.

Figures 3A, 3B:
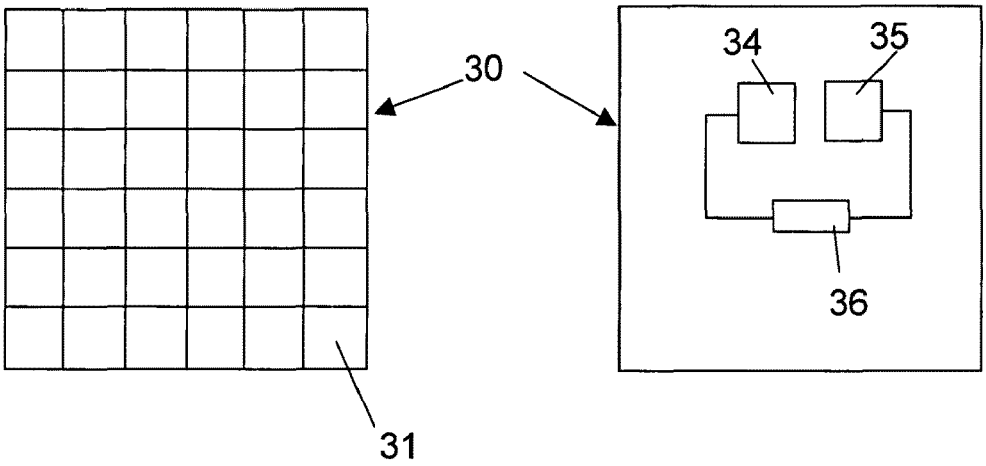
FIG. 3A and FIG. 3B illustrate a display board according to an embodiment of the invention.

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

With "light" in the present invention is meant electromagnetic radiation with a wavelength between 375 and 1000 nm, i.e. visible light, IR radiation, near IR and UV radiation.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

The present invention, in embodiments thereof, provides a display board comprising an array of light emitting elements, e.g. LEDs, and age determination means, as well as a method for detecting aging of a display board. The method according to embodiments of the present invention yields data which can then be used for adapting the driving of the light emitting elements of the array, e.g. LEDs, so as to correct for decreasing light intensity because of aging of the light emitting elements, e.g. LEDs, of the array.

Embodiments of the present invention may be applied to passive or active matrix displays and to monochrome or colour displays. Furthermore, the displays may be flat or curved displays. The boards and/or tiles optionally used in such displays may be flat or curved themselves as well.

When in the description and claims is referred to an array of light emitting elements, e.g. LEDs, a structure is meant in which the light emitting elements, e.g. LEDs, are logically organised in rows and columns. The terms "column" and "row" are used to describe sets of the array of light emitting elements, e.g. LEDs, which are linked together. The linking can be in the form of a Cartesian array of rows and columns however the present invention is not limited thereto. As will be understood by those skilled in the art, columns and rows can be easily interchanged and it is intended in this disclosure that these terms be interchangeable. Also, non-Cartesian arrays may be constructed and are included within the scope of the invention. Accordingly the terms "row" and "column" should be interpreted widely. Each display element, e.g. LED, may be individually addressable. According to embodiments of the invention, display boards may comprise current addressed or voltage addressed light emitting elements, e.g. LEDs.

Hereinafter, the present invention will be described by means of LEDs as light emitting elements. This is not limiting the invention in any way; any suitable light emitting element known by a person skilled in the art may be used with the present invention.

When in the description and the claims the term "light emitting element" is used, it is meant to cover an active light emitting element that can be addressed electronically and includes the following possibilities: ELs (electroluminescent devices) in general, TFELs (thin films ELs), LEDs (light emitting diodes), OLEDs (organic light emitting diodes) and PLEDs (polymeric light emitting diodes).

The present invention will mainly be described with reference to LED's but the present invention is not limited thereto.

An embodiment of the present invention, as illustrated in FIG. 2, provides a display board 30 comprising an array of light emitting elements such as LEDs 31, driving means 32 for driving the LEDs 31 with image data and aging determination means 33. According to embodiments of the present invention, the aging determination means 33 comprises at least a first reference LED 34 and a second reference LED 35. The first and second reference LED 34, 35 may most preferably be from a same batch as the LEDs 31 of the array on the display board 30.

The first reference LED 34 is, during functioning of the display board 30, driven with reference data equal to a value derived from the image data for driving the LEDs 31 of the array e.g. by means of an algorithm on the display board 30. According to embodiments of the invention, the algorithm may comprise deriving an average value of the image data. According to other embodiments, the algorithm may comprise deriving a peak value of the image data. According to still other embodiments, the algorithm may comprise deriving a combination of a peak value and an average value, or in other words off-setting an average value of the image data with a peak value of the image data. In the following description, reference data for driving the first reference LED 34 will be referred to as being equal to an average of the image data for driving the LEDs 31 of the array. It has to be understood that this is not limiting the invention in any away and that other algorithms as described above can also be used to determine the value of the reference data in accordance with embodiments of the present invention. This means that the first reference LED 34 has substantially the same usage, and thus shows substantially the same aging, as the LEDs 31 of the array on the display board 30. The first reference LED 34 may also be called an average LED. This first reference LED 34 corresponds, throughout the useful life of the display board 30, with the average actual history of the LEDs 31. At the time of an intermediate calibration of the display board 30, i.e. when the display board 30 is calibrated during use after a particular period thereof, the first reference LED 34 is driven with first calibration data.

The second reference LED 35 is normally not used. This LED 35 corresponds with a LED with the initial state of the LEDs 31 of the display board 30. This means that, during functioning of the display board 30, when the LEDs 31 of the array on the display board 30 are in use and thus when the first reference LED 34 is driven with reference data equal to a value derived from the image data for driving the LEDs 31 of the array by means of an algorithm, the second reference LED 35 is not driven. The second reference LED 35 is only used at intermediate calibration time and is then driven with second calibration data. The second reference LED 35 is a LED which corresponds with the "new state" of the LEDs 31 of the array on the display board 30 at the time of factory calibration. According to embodiments of the present invention, the first and second calibration data may be the same or may be different. When the first and second calibration data are the same, a same output would be expected for the first and second reference LED 34, 35. However, in some cases, the outputs of the first and second reference LED 34, 35 can be different. This difference is a calibration difference and is not attributed to aging, but should be corrected for when determining aging of the LEDs 31 of the array. Correction for the calibration difference can be done by means of specific software.

The aging determination means 33 furthermore comprises light measurement means 36 for, during intermediate calibration, measuring light emitted by the first and second reference LED 34, 35 and comparison means 37 for comparing light emitted by the first reference LED 34 with light emitted by the second reference LED 35 and for, based on the comparison result, deciding on aging of the LEDs 31 of the array on the display board 30. The light measurement means 36 are adapted for measuring the brightness levels of the first and second reference LEDs 34, 35. The light measurement means 36 may be photodiodes. The light measurement means preferably have an optical transfert curve which is as flat as possible over the spectrum to be measured. The measurement resolution is preferably high enough to measure small enough differences between radiated light of the first and second reference LEDs 34, 35.

Figure 7:
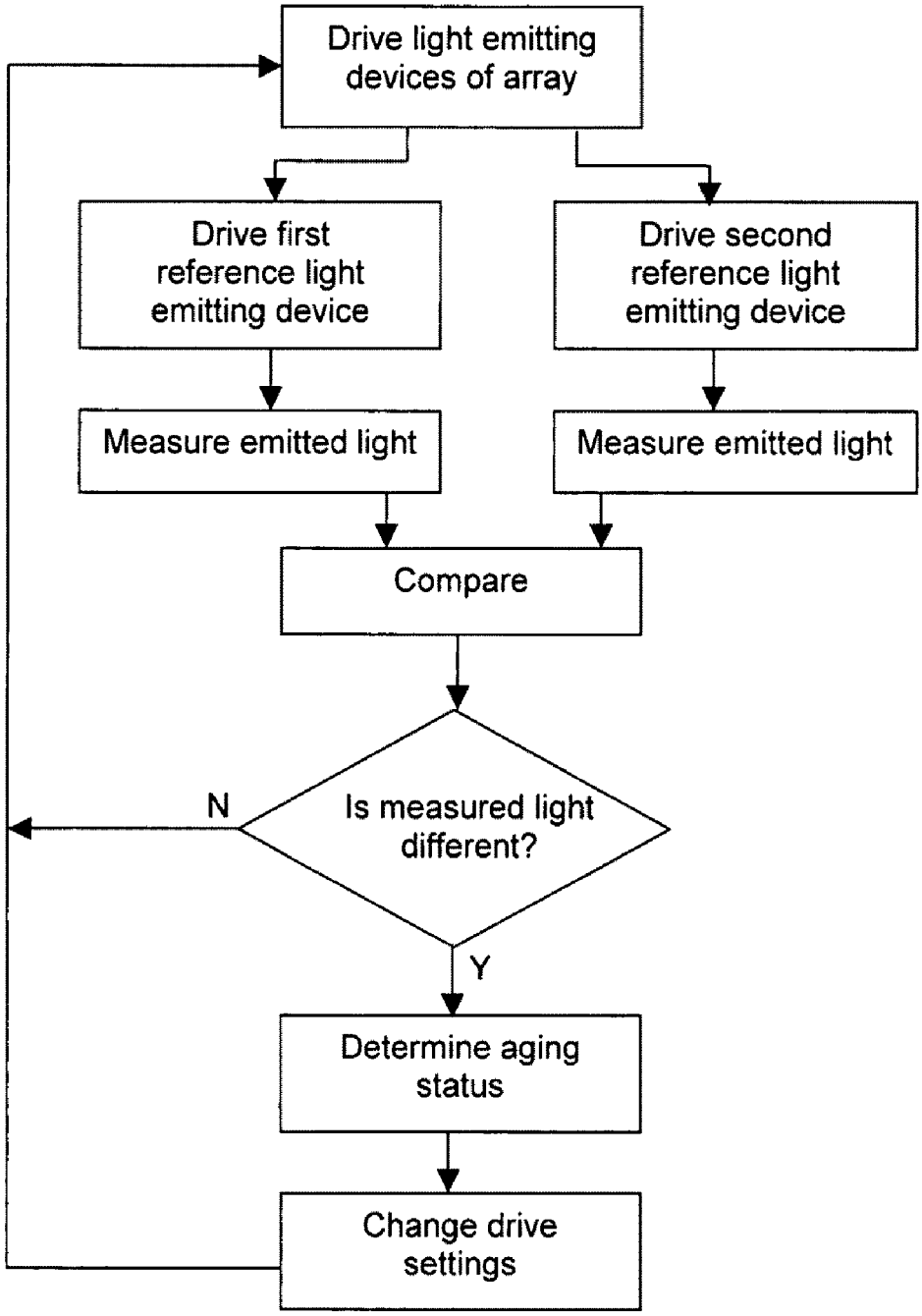
FIG. 7 is a flow diagram of a method according to embodiments of the present invention.

FIG. 7 schematically illustrates the principle of embodiments of the present invention. During use of a display board 30, i.e. while displaying images intended to be looked at by at least one spectator, the display board 30 comprising an array of LEDs 31 is driven with image data by driving means 32. At the same time, driving means 32 also drives the first reference LED 34 with reference data which equals to an average of the image data for driving the LEDs 31 of the array. After a certain period of time, e.g. at every start-up of the device, or after a predetermined number of hours of ON time have elapsed, e.g. 20 hours, an intermediate calibration of the LEDs 31 of the array on the display board 30 may be performed. For this purpose, the first reference LED 34 is driven with first calibration data and light emitted by the first reference LED 34 is measured by a first light measurement means 36, which may, for example, be a photodetector, a phototransistor, a photoelectric cell, a photodiode, . . . . Then, at substantially the same time or shortly before or after, the second reference LED 35 is driven with second calibration data and light emitted by the second reference LED 35 is measured by a second light measurement means, which may, for example, be a photodetector, a phototransistor, a photoelectric cell, a photodiode, . . . . Preferably, the first calibration data is equal to the second calibration data, although in principle both could be different. According to particular embodiments, and as illustrated in FIG. 2, the first and second light measurement means may be the same. However, according to other embodiments (not shown), the first and second reference LED 34, 35 may each be coupled to a different light measurement means. It has to be noted that when, according to embodiments of the invention, the outputs of the first and second reference LED 34, 35 is measured with a different light measurement means 36, the steps of driving and measuring the first reference LED 34 may be done in parallel to the steps of driving and measuring the second reference LED 35. However, when the outputs of the first and second reference LED 34, 35 is done by a same light measurement means 36, the steps of driving and measuring the first and second reference LED 34, 35 cannot be done in parallel and the driving and measuring the first reference LED 34 may be performed before driving and measuring the second reference LED 35 or vice versa.

In a next step, the light emitted by the first reference LED 34 is compared to the light emitted by the second reference LED 35 by comparison means 37. The difference between the light emitted by the first reference LED 34 and the light emitted by the second reference LED 35 is an indication for the aging status of the LEDs 31 of the array on the display board 30.

The difference between the light emitted by the first reference LED 34 and the light emitted by the second reference LED 35 obtained as described above may then be used to correct overall calibration values for adapting the driving parameter of the LEDs 31, bringing the actual LED aging into account. This can be done by changing the driving parameter of the driving means 32 by means of controller 38. For example, when the LEDs 31 of the array on the display board 30 are voltage-driven, correction for aging may be done by adapting the voltage the LEDs 31 are driven with based on the calibration values, such that no loss of brightness occurs because of aging of the LEDs 31. When the LEDs 31 of the array on the display board 30 are current-driven, the current the LEDs 31 are driven with may be adapted based on the calibration values, such that no loss of brightness occurs because of aging of the LEDs 31.

An advantage of the display board 30 and method according to embodiments of the present invention is that both the light emitted by the first reference LED 34 and the light emitted by the second reference LED 35 are determined on a same display board 30 or in other words, are both measured under the same circumstances. Therefore, compared to the prior art where the light emitted by a reference LED is compared with an a priori knowledge of the characteristics of the device or simply compared to some arbitrary value empirically shown to give good performance, embodiments of the present invention may lead to more reliable and up to date determination and thus of subsequent compensation for the aging problem of the LEDs 31.

Furthermore, when using a single light measuring means 36 for determining the light emitted by the first reference LED 34 and the second reference LED 35, in case a difference is made between the light emitted by the first reference LED 34 and the light emitted by the second reference LED 35, possible errors emanating from the light measurement means 36 may be minimised or even excluded.

An additional advantage of particular embodiments, i.e. the embodiments where the light emitted by the first reference LED 34 is measured by the same light measurement means 36 as the light emitted by the second reference LED 35 is that also can be compensated for aging drift of the light measurement means 36, e.g. photodetector, phototransistor, photoelectric cell, photodiode, . . . , because the drift on this component is always re-normalized by making the difference between the light emitted by the first reference LED 34 and measured by the light measurement means 36 and light emitted by the second reference LED 35 and measured by the same light measurement means 36.

An extended version of a process in accordance with embodiments of the present invention is illustrated hereinafter, referring to FIG. 8 and FIG. 9.

Figure 8:
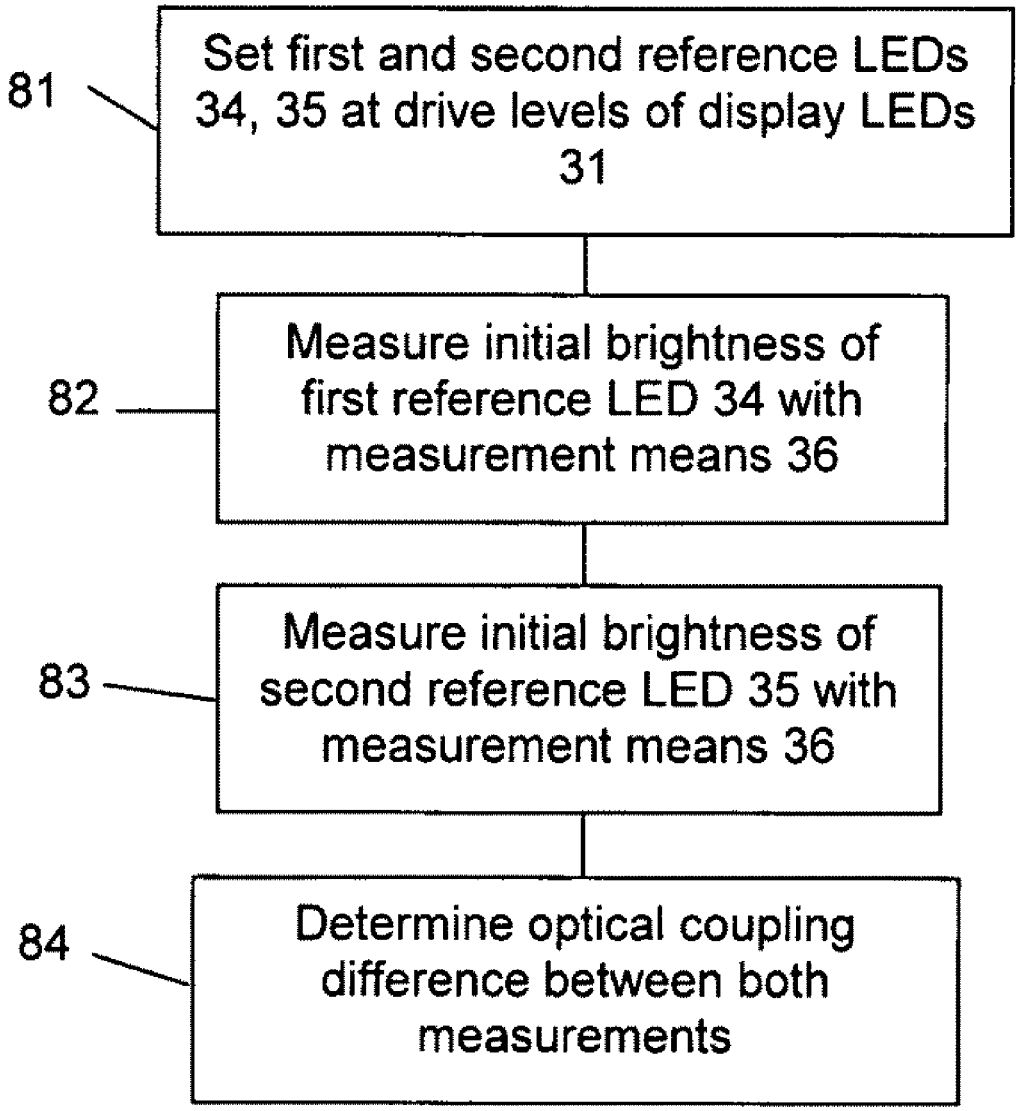
FIG. 8 is a flow diagram of an initialisation phase of a method according to embodiments of the present invention, in case the first and second reference LEDs are of the same type as the display LEDs.

Phase 1 is the initial phase, illustrated in the flow chart of FIG. 8. This is the measurement and calibration phase (color and brightness) of the board 30. The first and second reference light emitting elements, e.g. LEDs 34, 35, are driven at a same level as the display light emitting elements, e.g. LEDs 31. The initial brightness of the first and second reference LEDs 34, 35 is measured, steps 82 and 83, and optionally stored. From the measured initial brightness values, an optical coupling difference between both measurements is determined as a constant error value, step 84. This process determines the initial difference between the first and second reference LEDs 34, 35, which includes brightness differences between first and second reference LEDs 34, 35 at the same drive parameters and the difference measured by the measurement means 36 because of different optical coupling from the first reference LED 34 to the measurement means 36 and the second reference LED 35 to the measurement means 36, step 84.

Phase 2 is the normal life of the display board 30. The first reference LED 34 is driven with reference data equal to a value derived from the image data for driving the LEDs 31 of the array e.g. is driven at the average value of the display LEDs 31. The second reference LED 35 is not driven. This second reference LED will only be used when field recalibration is executed.

Figure 9:
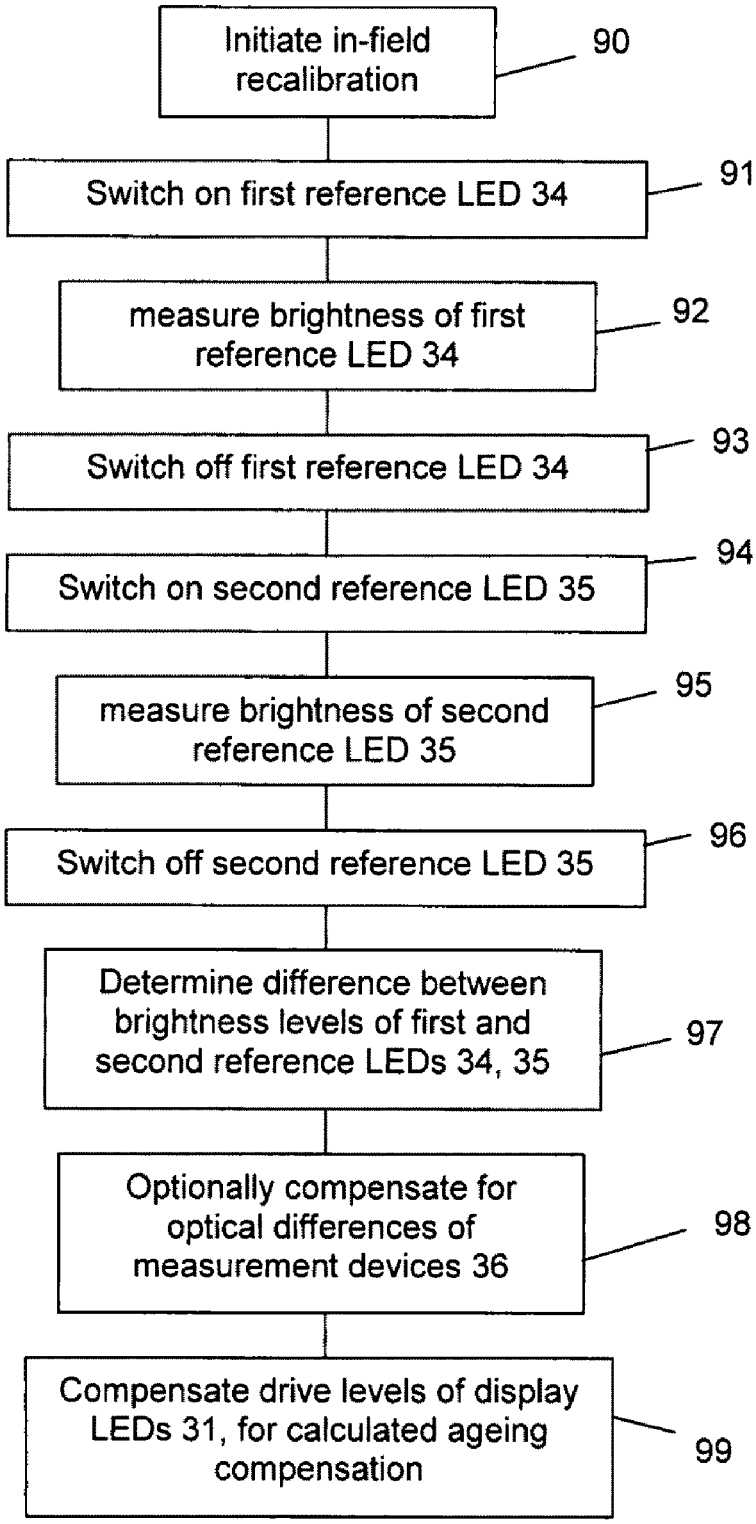
FIG. 9 is a flow diagram of in-field recalibration in accordance with an embodiment of the present invention in the same circumstances as for FIG. 8.

Phase 3 is the in-field recalibration phase, illustrated in the flow chart of FIG. 9. At a certain moment in time, the display LEDs 31 have aged significantly, because of usage/runtime of the display board 30 up to the level of visibility. An aim of embodiments of the present invention is to get the display LEDs 31 back to their initial factory performance. Phase 3 of the process, the in-field recalibration process, can be initiated, step 90. In this process, the first and second reference LEDs 34, 35 are driven in the same way for the different colours, e.g. R, G, B and W. The first reference LED 34 is switched on, step 91, and its brightness is measured, step 92, after which the first reference LED is switched off, step 93. The second reference LED 35 is switched on, step 94, and its brightness is measured, step 95, after which the first reference LED is switched off, step 96. The brightness of first and second reference LEDs 34, 35 may be measured one after the other, either of these being measured first. Alternatively, if two separate measurement means 36 are used for measuring brightness of first and second reference LEDs 34, 35, the measurements can be performed in parallel. The difference between the brightness levels of first and second reference LEDs 34, 35 is determined, step 97. Since the second reference LED 35 has never been used, it intrinsically represents the initial state of the display LEDs 31 at 0-hours life. Since the first reference LED 34 has been driven with reference data equal to a value derived from the image data for driving the LEDs 31 of the array e.g. by means of an algorithm on the display board 30, the reference LED 34 has substantially the same usage, and thus shows substantially the same aging as the LEDs 31 of the array on the display board 30. The difference between the light emitted by the first reference LED 34 and the light emitted by the second reference LED 35 is an indication for the aging status of the LEDs 31 of the array on the display board 30. It is known that measurement means 36 can change property over time and temperature. Since the initial difference between first and second reference LEDs 34, 35 is known from phase 1, as well as the optical measurement difference of the measurement values of the measurement means 36 for the first and second reference LEDs 34, 35, a compensation for the optical differences of the measurement device 36 can be made, step 98, and the resulting aging can be calculated. The driving parameters of display LEDs 31 can be compensated for the determined ageing.

A concept of embodiments of the method is that the actual initial reference is on board of the display board 30 (by means of the second reference LED 35) and by re-measuring the second reference LED 35 during an in-field recalibration, the electrical drift of the measurement means 36 is eliminated. The only difference between measurements is then the optical difference caused by the difference in light coupling between first reference LED 34/optical measurement means 36 and second reference LED 35/optical measurement means 36. Since the latter is constant, the difference in aging between first and second reference LEDs 34, 35 remains. The adjustment results in a level 1 adjustment on the display board 30 LEDs 31 and the drive levels of the first and second reference LEDs 34, 35.

Hereinafter some examples will be discussed of possible implementations of the display board 30 according to embodiments of the present invention.

According to particular embodiments, the at least first and second reference LED 34, 35 may be provided at a side of the display board 30 opposite to the side of the display board 30 where the image is shown intended to be looked at. This is illustrated in FIGS. 3A and 3B which respectively show a front side and a back side of a display board 30 according to embodiments of the invention. In FIG. 3B, for reasons of simplicity, only the first and second reference LED 34, 35 and the light measurement means 36 are illustrated. Most preferably, as already discussed above, the first and second reference LED 34, 35 may be coupled to a same light measurement means 36 which is for measuring light emitted by the first and second reference LED 34, 35 when driven by respectively first and second calibration data. According to other embodiments, however, the first and second reference LED 34, 35 may each be coupled to a different light measurement means 36.

An advantage of the example illustrated in FIG. 3A and 3B is that the provision of aging determination means 33 does not alter the size of the display board 30 because it is provided at the backside of the display board 30. Furthermore, the provision of at least a first and second reference LED 34, 35 does not disturb the image provided at the display board 30 because none of the at least first and second reference LEDs 34, 35 is part of the array of LEDs 31 on the display board 30.

Another advantage of the embodiments illustrated in FIGS. 3A and 3B is that they can more easily be used in tiled displays.

Figures 4A, 4B:
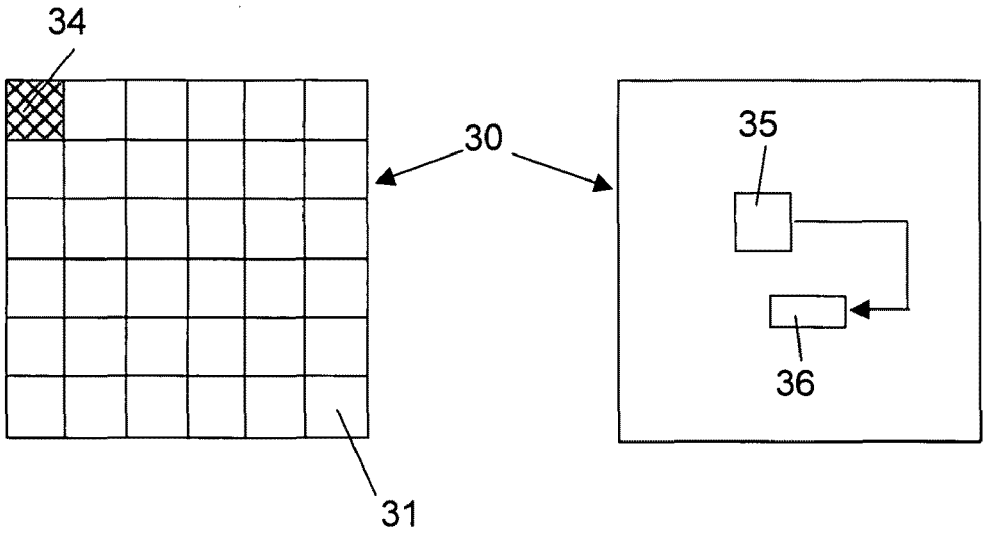
FIG. 4A and FIG. 4B illustrate a display board according to another embodiment of the invention.

According to other embodiments, and as illustrated in FIG. 4A and 4B, the first reference LED 34 may be a LED which is part of the array of LEDs 31 at the front side of the display board 30 and may thus also be provided at the front side of the display board 30 (see FIG. 4A). The second reference LED 35 may be provided at the side opposite to the side where the first reference LED 34 is provided and may thus be provided at the back of the display board 30 (see FIG. 4B). Again, both the first and second reference LED 34, 35 may most preferably be coupled to a same light measurement means 36, which preferably is located at the backside of the display board 30. The first reference LED 35 may be coupled to the light measurement means 36 by, for example, a light pipe (not shown in the figures) for coupling the light emitted by the first reference LED 34 from the front side of the display board 30 to the backside of the display board 30. According to other embodiments, the first and second reference LED 34, 35 may each be coupled to a different light measurement means 36 which may be located at the front side or the back side of the display.

Figure 5:
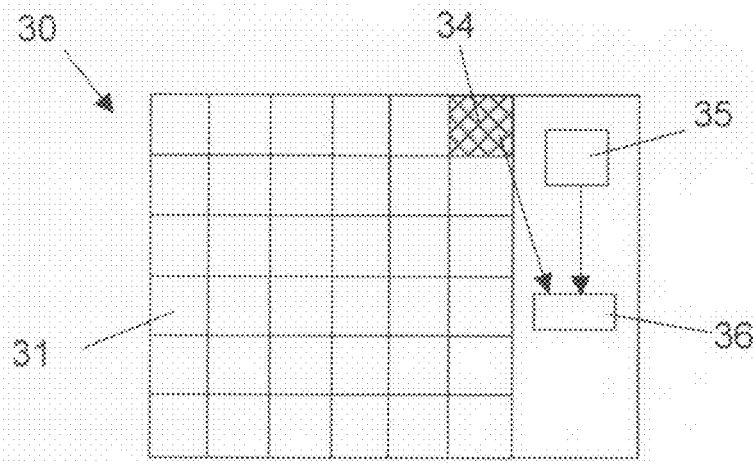
FIG. 5 illustrates a display board according to a further embodiment of the invention.

According to other embodiments, illustrated in FIG. 5, the first and second reference LED 34, 35 may both be provided at the same side of the display board 30 as the array of LEDs 31. The first reference LED 34 may, similarly to the embodiment illustrated in FIG. 4A and 4B, be formed by a LED which is part of the array of LEDs 31 on the display board 30. The second reference LED 35 may be provided next to the array of LEDs 31, also at the front side of the display board 30. The part next to the array of LEDs 31 where the second reference LED 35 is provided may, according to embodiments of the invention, be covered so as to hide the reference LED 35 (not shown). Most preferably, both the first and second reference LED 34, 35 are coupled to a same light measurement means 36 which may preferably be provided next to the array of LEDs 31, as illustrated in FIG. 5. According to other embodiments, the first and second reference LED 34, 35 may each be coupled to a different light measurement means 36.

A disadvantage of the embodiments illustrated in FIGS. 4A, 4B and 5 is that the first reference LED 34, which is driven by reference data equal to an average of the image data the LEDs 31 of the array are driven with, is formed by a LED which is part of the array. Hence, this may disturb the image formed on the display board 30. In order to avoid this, the first reference LED 34 could be hidden from direct view, e.g. by a non-transparent covering means.

Figure 6:
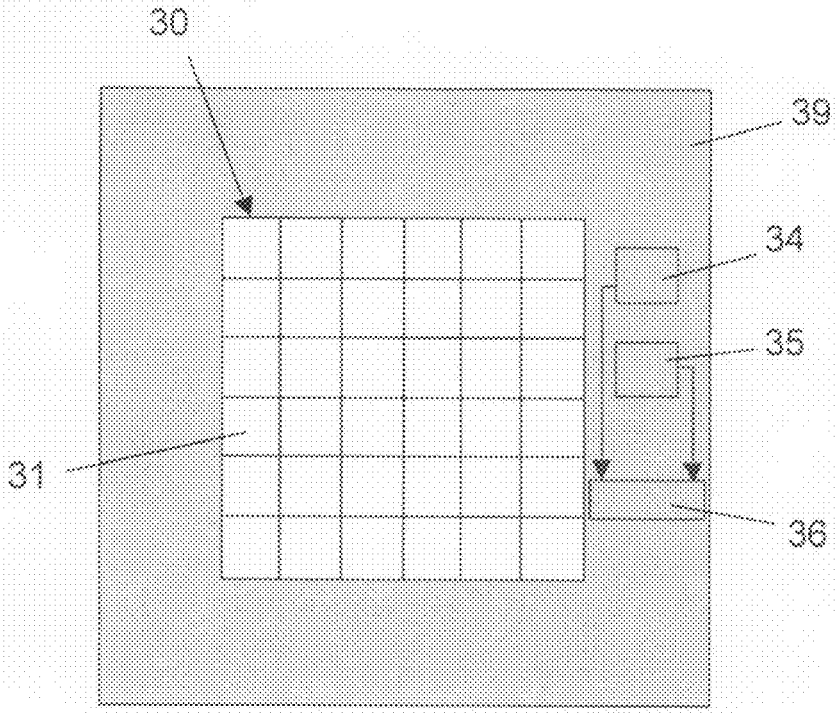
FIG. 6 illustrates a display board according to yet another embodiment of the invention.

According to still other embodiments of the invention, both the first and second reference LED 34, 35 may be provided at the front side of the display board 30 next to the array of LEDs 31, as illustrated in FIG. 6. Most preferably, both the first and second reference LED 34, 35 may be coupled to a same light measurement means 36. According to other embodiments, the first and second reference LED 34, 35 may each be coupled to another light measurement means 36.

The display board 30 according to the embodiment illustrated in FIG. 6 has the disadvantage that the provision of aging determination means 33 to the display board 30 alters the size of the display board 30. However, because none of the first or second reference LED 34, 35 is part of the array of LEDs 31, the provision of the age determination means 32 will not disturb in any way the image provided by the display board 30.

The edges of the display board 30 may be covered by a cover 39, as illustrated in FIG. 6. In that way, the first and second reference LED 34, 35 and the light measurement means 36 may be covered and thus may be hidden and may be protected against environmental influences.

The above-described embodiments all relate to display boards 30 comprising one kind of LEDs, i.e. all the LEDs on the display board 30 are of a same colour and thus the above-described embodiments relate to monochrome display boards and thus only require one first and one second reference LED 34, 35.

However, according to other embodiments of the present invention, the display board 30 may comprise LEDs 31 of different colours. It is known that LEDs 31 with different colours age in a different way. Therefore, the aging determination means 33 may comprise a first reference LED 34 and a second reference LED 35 for each colour. For example, if the display board 30 comprises red, green and blue LEDs the aging determination means 33 may comprise a red first and second reference LED, a green first and second reference LED and a blue first and second reference LED.

According to other embodiments of the present invention, the display board 30 may comprise multi-colour LEDs, each LED comprising e.g. three colours. In this case, only one first reference LED 34 and one second reference LED 35 may be provided, the first and second reference LEDs 34, 35 being the same multi-colour LEDs as the multi-colour LEDs 31 of the array on the display board 30.

Figure 10:
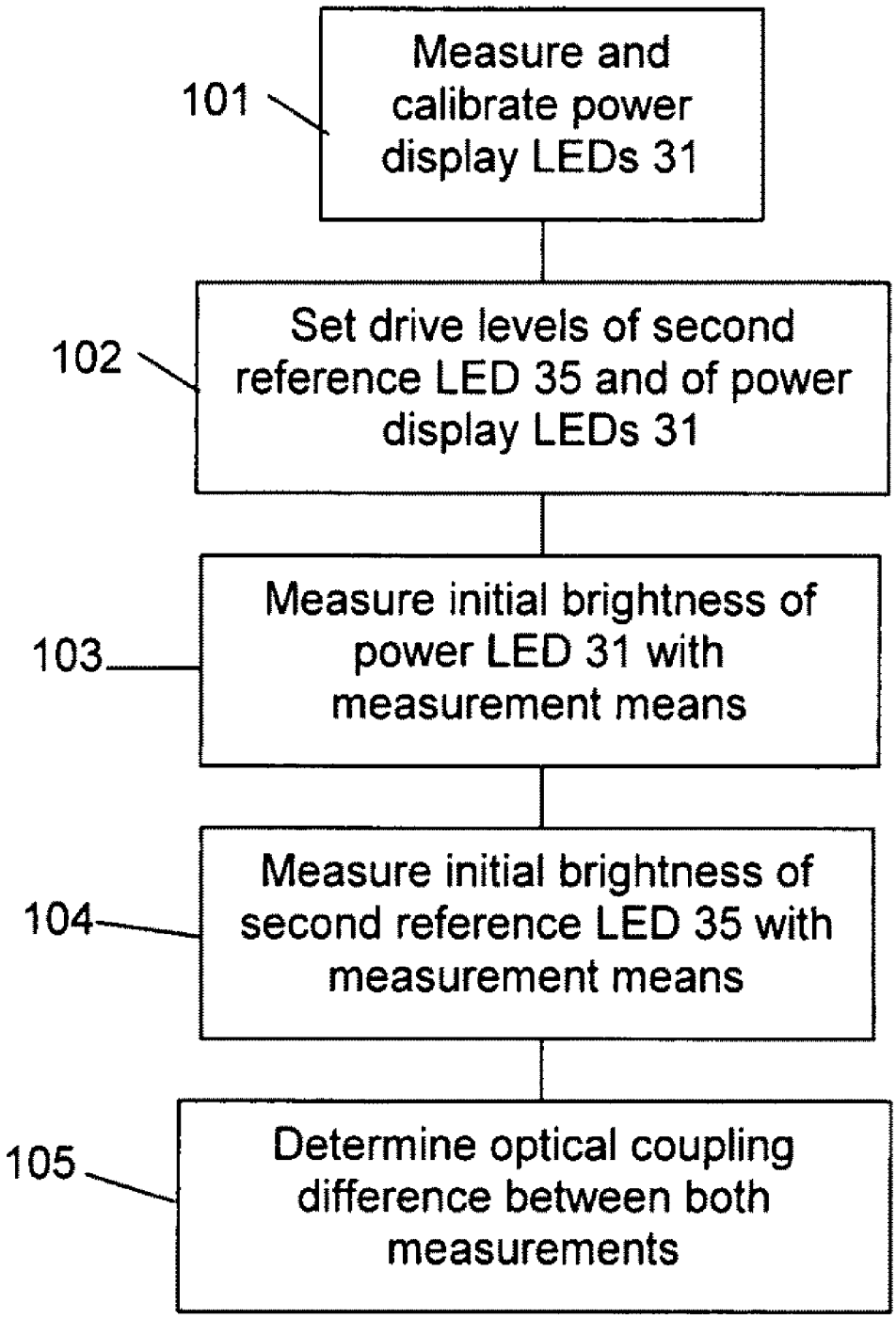
FIG. 10 is a flow diagram of an initialisation phase of a method according to embodiments of the present invention, in case the reference LEDs are of different type as the display LEDs.

According to still other embodiments, not all light emitting elements, e.g. LEDs, are of the same type. For example, the display LEDs 31 may be power LEDs, as typically applied in display applications, e.g. outdoor display applications, where LEDs are used to form the pixels of the display board 30. Most often it is too expensive to provide, on top of the display LEDs 31 also first and second reference LEDs 34, 35 as power LEDs, as such power LEDs are much more expensive than other LEDs. Of course, if there is no objection to extend the display board 30 to carry first and second reference "power LEDs" 34, 35, the basic principle of aging compensation as in embodiments of the present invention set out above can be applied. In the case of a power LED based application, however, the first and second reference LEDs 34, 35 under the form of a power LED would add a significant cost to the display board 30. Therefore, first and second reference LEDs 34, 35, according to embodiments of the present invention, can be replaced by a cheaper alternative. Only one cheap reference LED needs to be provided; however, a plurality of reference LEDs may be provided. The one or more reference LEDs should show the same ageing characteristics as the display LEDs 31. This embodiment requires that the measurement means 36 can sample the light of the power LEDs 31 and also the light of the cheaper reference LED 35. The process again comprises 3 phases:

Phase 1 is the Initial phase and is illustrated in the flow chart of FIG. 10. This is the measurement and calibration phase of the display board 30. The power LEDs 31 are switched on, measured and calibrated, according to any normally used process as known by a person skilled in the art, step 101. Once this process is finished, drive parameters are set for driving the second reference LED 35 and the power display LEDs 31, step 102. The measurement means 36 is activated, in order to measure the light output of one or more power LEDs 31, step 103. This is the 0-hour reference of the actual power LEDs 31. Next, the measurement means 36 measures the brightness of the second reference LED 35, step 104. The order of both measurements may be switched. Alternatively, if separate measurement means are used for measurements performed on the one or more power LEDs 31 and on the second reference LED 35, both measurements may be performed in parallel. The optical coupling difference between both measurements is determined, e.g. as a constant error value, step 105. The second reference LED 35 in this embodiment typically is a cheaper LED, e.g. an RGB high efficiency SMD LED. The difference between both measurements corresponds with the initially measured errors (optical and efficiency wise). These errors remain constant throughout the life of the display board 30 because the optical coupling from the power LED 31 and the second reference LED 35 to the measurement means 36 does not change, and the second reference LED 35 intrinsically does not age because it is never used, except for the very short moments when a field re-calibration is done. The runtime of the second reference LED 35 is therefore negligible. Once the above differences are determined, the system is ready for useful life.

Phase 2 is the normal life of the display board 30. The power LEDs 31 are driven as normal. The second reference LED 35 is not driven at all.

Figure 11:
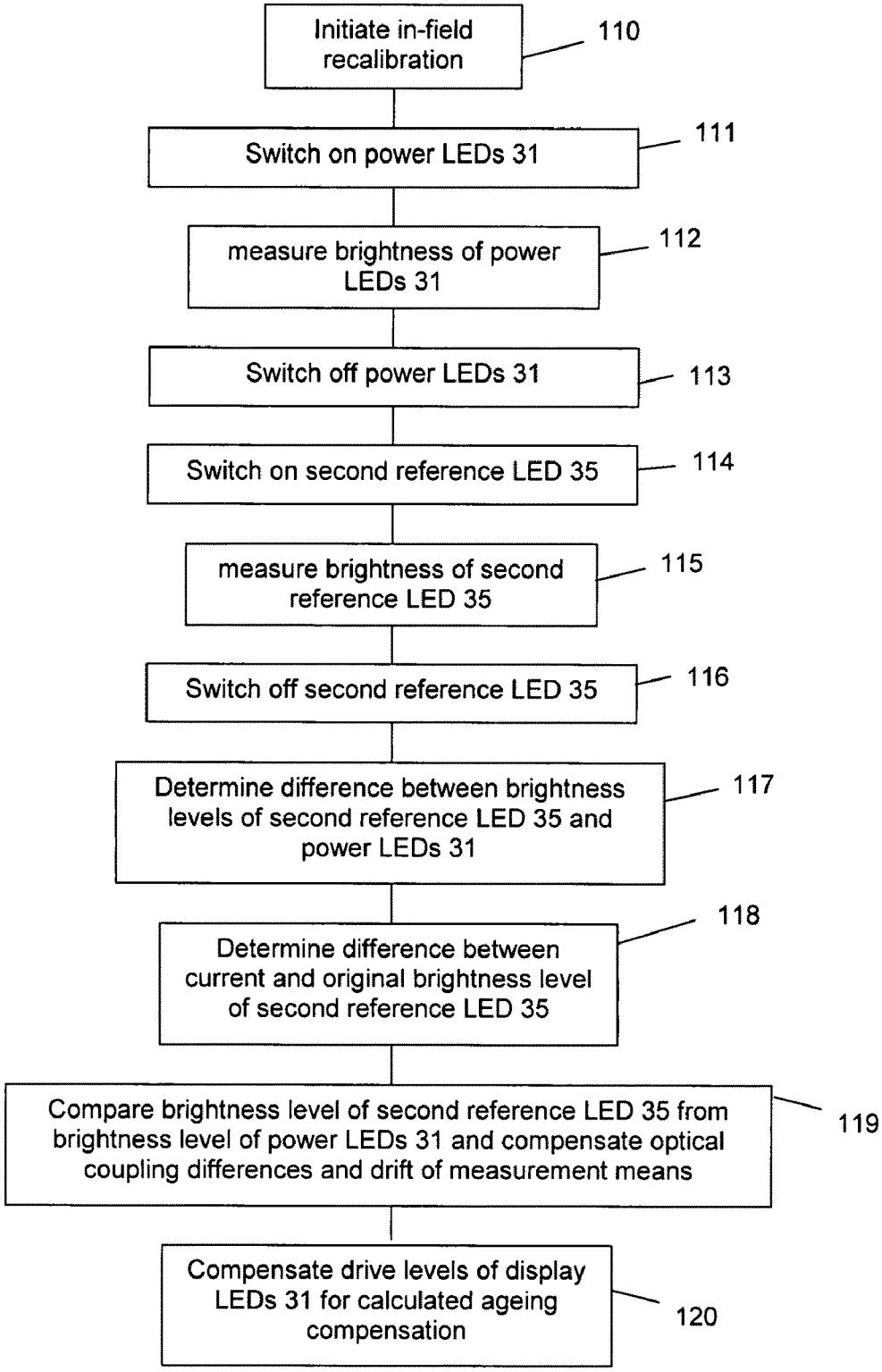
FIG. 11 is a flow diagram of in-field recalibration in accordance with an embodiment of the present invention in the same circumstances as for FIG. 10.

Phase 3 is the in-field recalibration phase, illustrated in the flow chart of FIG. 11. When the step of in-field calibration is activated, step 110, the following process is executed. One or more of the power LEDs 31 (which are the display LEDS) are switched on, step 111, and measured by the measurement means 36, e.g. at R, G, B and W, step 112. Optionally the measurement of the brightness of the one of more power LEDs 31 may include an averaging action. The one or more power LEDs 31 are switched off, step 113. The one or more second reference LEDs 35 (which are e.g. single or multiple low power SMD RGB leds) are switched on, step 114. The measurement means 36 measures the brightness levels of the second reference LED or LEDs 35, e.g. on RGB and W, step 115. The one or more second reference LEDs 35 are switched off, step 116.

The measurement result of the second reference LED 35 is compared with the original value, step 118, which may have been stored in a memory. The difference between these values determines the drift of the measurement means 36, which can also be used for the power LED measurements.

The difference between brightness levels of the second reference LED 35 and power LEDs 31 is determined, step 117.

The brightness level of the second reference LED 35 is compared to the brightness level of the power LEDs 31, step 119. A compensation for optical coupling differences may be made. Measuring both values of the power LEDs 31 and the second reference LEDs 35 with the same measurement means 36 fully eliminates drifts of the measurement means 36. The optical coupling difference is known and constant over life, and is taken into account in the compensation calculation, yielding a correction of the drive of the power LEDs 31 in order to compensate for their aging (and thus run-time), step 120.

Again it is a concept of this embodiment that the actual initial reference is on board of the display board 30 (by means of the reference LED 35) and by re-measuring the reference LED 35 during an in-field recalibration, the electrical drift of the measurement means 36 is eliminated. It is to be understood that although preferred embodiments, specific constructions and configurations, as well as materials, have been discussed herein for devices according to embodiments of the present invention, various changes or modifications in form and detail may be made without departing from the scope and spirit of this invention as defined by the appended claims.

The invention claimed is:

1. A display board comprising an array of addressable light emitting elements and driving means for driving the light emitting elements with image data, the display board furthermore comprising aging determination means comprising:

at least one reference light emitting element, the driving means being adapted for driving the at least one reference light emitting element with calibration data, light measurement means for measuring light emitted by the reference light emitting element, and for measuring light representative of the light emitted by the light emitting elements, and comparison means for comparing measured light emitted by the reference light emitting element with measured light representative of the light emitted by the light emitting elements and for, based on the comparison result, deciding on aging of the light emitting elements in the array;

wherein the at least one reference light emitting element comprises at least a first and second reference light emitting element, the driving means being adapted for driving the first reference light emitting element at first moments in time with reference data equal to a value derived from the image data for driving the light emitting element of the array and with first calibration data at second moments in time so as to emit light representative of the light emitted by the light emitting elements, and for driving the second reference light emitting element at the second moments in time with second calibration data, wherein the light measurement means is adapted for measuring light emitted by the first and second reference light emitting element, and wherein the comparison means is adapted for comparing measured light emitted by the first reference light emitting element with measured light emitted by the second reference light emitting element and for, based on the comparison result, deciding on aging of the light emitting elements in the array.

2. A display board according to claim 1, wherein the light emitting elements and the at least one reference light emitting element are of different types.

3. A display board according to claim 1, wherein the light emitting elements and the at least one reference light emitting element are of same types.

4. A display board according to claim 1, wherein the value derived from the image data is an average value of the image data.

5. A display board according to claim 1, wherein the display board furthermore comprises compensation means for compensating the light emitting elements in the array for aging based on the decision on aging.

6. A display board according to claim 1, wherein the display board furthermore comprises a controller for controlling the driving means.

7. A display board according to claim 1, the array of light emitting elements being provided at a first side of the display board, wherein the at least one reference light emitting elements are provided at a second side of the display board, the second side being opposite to the first side.

8. A display board according to claim 1, the array of light emitting elements being provided at a first side of the display board, wherein the first reference light emitting element is provided at the first side of the display board and wherein the second reference light emitting element is provided at a second side of the display board, the second side being opposite to the first side.

9. A display board according to claim 1, wherein the at least one reference light emitting elements are provided at a same side of the display board as the array of light emitting elements.

10. A display board according to claim 1, wherein the first and second reference light emitting elements are coupled to a same light measurement means.

11. A display board according to claim 1, wherein the light measurement means comprises at least one photodetector or phototransistor.

12. A display board according to claim 1, the display board comprising light emitting elements of different colours, wherein at least one reference light emitting element is provided for each colour.

13. A display board according to claim 1, the display board comprising multi-coloured light emitting elements, wherein the at least one reference light emitting element of the aging determination means are multi-coloured light emitting elements.

14. A display board according to claim 1, wherein the light emitting elements of the array are LEDs.

15. A display board according to claim 1, wherein the display board is incorporated in a display tile.

16. A display board according to claim 15, wherein a plurality of display tiles form a display.

17. Method for determining aging of a display board, the display board comprising an array of light emitting elements, driving means for driving the light emitting elements with image data, and at least one reference light emitting element, the method comprising:

measuring light representative of the light emitted by the light emitting elements, driving the reference light emitting element with calibration data and measuring light emitted by the reference light emitting element, and comparing the light representative of the light emitted by the light emitting elements with the light emitted by the reference light emitting element and, based on the comparison result, deciding on aging of the light emitting elements in the array;

wherein measuring light representative of the light emitted by the light emitting elements comprises driving a first reference light emitting element with first calibration data and measuring light emitted by the first reference light emitting element and driving the reference light emitting element with calibration data and measuring light emitted by the reference light emitting element comprises driving a second reference light emitting element with second calibration data and measuring light emitted by the second reference light emitting element.

18. Method according to claim 17, wherein measuring light representative of the light emitted by the light emitting elements comprises measuring light emitted by the light emitting elements.

19. A method according to claim 17, wherein the first calibration data is equal to the second calibration data.

20. A method according to claim 17, comprising, before driving the first and second reference light emitting elements with first and second reference data respectively, driving the light emitting elements of the display board with image data and driving the first reference light emitting element with a value derived from the image data by means of an algorithm.

21. Method according to claim 20, wherein the algorithm comprises deriving a value derived from the image data, the value being an average value of the image data.

22. Method for calibrating a display board, the display board comprising an array of light emitting elements, the method comprising:

determining the degree of aging of the light emitting elements of the array in accordance with a method according to claim 17, and compensating the light emitting elements in the array for aging based on the determined degree of aging.

23. Method according to claim 22, wherein compensating the light emitting elements in the array for aging is performed by adapting a driving parameter of the light emitting elements of the array.

24. Method according to claim 23, wherein the driving parameter is a voltage.

25. Method according to claim 23, wherein the driving parameter is a current.

* * * * *